US006011517A

United States Patent [19]

Skurski

[11] Patent Number: 6,011,517

[45] Date of Patent: Jan. 4, 2000

[54] SUPPORTING AND HOLDING DEVICE FOR STRIP METAL RF ANTENNA

[75] Inventor: James K. Skurski, Gainesville, Ga.

[73] Assignee: Matsushita Communication Industrial Corporation of U.S.A., Peachtree, Ga.

[21] Appl. No.: 08/929,840

[22] Filed: Sep. 15, 1997

[51] Int. Cl.[7] ..... H01Q 1/24

[52] U.S. Cl. ..... 343/702; 343/878; 343/879

[58] Field of Search ..... 343/700 MS, 702, 343/878, 879, 906; 455/89, 90; H01Q 1/24

[56] References Cited

U.S. PATENT DOCUMENTS

| | | | |
|---|---|---|---|
| 2,514,992 | 7/1950 | Edelsohn | 343/803 |
| 3,560,981 | 2/1971 | Pestka | 343/702 |
| 3,699,580 | 10/1972 | Joseph et al. | 343/702 |
| 4,812,853 | 3/1989 | Negev | 343/700 MS |
| 4,816,838 | 3/1989 | Mizuno et al. | 343/771 |
| 5,048,118 | 9/1991 | Brooks et al. | 343/702 |
| 5,124,733 | 6/1992 | Haneishi | 343/700 MS |
| 5,163,833 | 11/1992 | Olsen et al. | 439/61 |
| 5,258,892 | 11/1993 | Stanton et al. | 361/814 |
| 5,270,722 | 12/1993 | Delestre | 343/700 MS |
| 5,283,591 | 2/1994 | Delmas | 343/755 |
| 5,510,802 | 4/1996 | Tsuru et al. | 343/700 MS |
| 5,555,459 | 9/1996 | Kraus et al. | 343/702 |
| 5,696,517 | 12/1997 | Kawahata et al. | 343/700 MS |
| 5,828,342 | 10/1998 | Hayes et al. | 343/702 |

*Primary Examiner*—Hoanganh Le
*Assistant Examiner*—Tan Ho
*Attorney, Agent, or Firm*—Charles L. Warner; Smith, Gambrell & Russell

[57] ABSTRACT

A radio frequency (RF) antenna supporting and holding device. The antenna supporting and holding device is a molded dielectric substrate which may be used to hold, support, and position upper and lower RF antennas prior to attachment of the upper and lower RF antennas to underlying circuitry, such as a printed circuit board (PCB). The antenna supporting and holding device includes molded features for attachment to the PCB. After attachment of the upper and lower RF antennas to the antenna supporting and holding device, the device may be connected to the PCB independent of the attachment of the leads of the upper and lower RF antennas to the PCB. Thus, the antenna supporting and holding device allows the upper and lower RF antennas to be accurately positioned on the PCB prior to soldering the leads of the RF antennas to corresponding connection points on the PCB. After soldering the upper and lower RF antennas to the PCB, the antenna supporting and holding device prevents movement or deformation of the RF antennas if the transceiver unit to which they are attached is dropped or vibrated.

18 Claims, 3 Drawing Sheets

SUPPORTING AND HOLDING DEVICE FOR STRIP METAL RF ANTENNA

FIELD OF THE INVENTION

This invention relates in general to antennas and antenna units, and more particularly, relates to a device for supporting and holding strip metal RF antennas attached to a printed circuit board.

BACKGROUND OF THE INVENTION

In recent years, the electronics industry has responded to the ever increasing use of electronic equipment by providing a variety of small, compact, and durable electronic components for use in such items as mobile telephones, radios, and paging devices. Radio frequency antennas have been integrated with such devices for receiving and transmitting radio frequency (RF) transmissions.

A surface-mounted antenna unit is disclosed in U.S. Pat. No. 5,510,802. A radiator machined from plated metal such as copper or copper alloy is brought into close contact with the top surface of a rectangular shaped dielectric substrate. The unit may be placed on a printed circuit board where the radiator is soldered to connection points on the printed circuit board.

U.S. Pat. No. 5,258,892 discloses a molded-in antenna with solderless interconnect for use in personal communication devices such as cordless telephones and pagers. A loop antenna is encased in a portion of the housing of the personal communication device and is positioned for connection with a printed circuit board.

An antenna for a hand-held RF transceiver terminal which conforms the antenna to the general shape of the terminal is disclosed in U.S. Pat. No. 5,555,459. An antenna element made of a thin layer of copper is bent, shaped and conformed to the various surfaces of a pre-formed underlying frame. The integrated frame and antenna may then be attached to a desired radio frequency transceiver of a portable electronic device.

In those systems, an antenna is supported by a molded substrate which is integrated with an RF transceiver. Such systems may support an antenna, but do not accurately position an antenna to underlying circuitry independent of attachment of the antenna to the underlying circuitry. Without accurately positioning the antenna prior to attaching the antenna to the underlying circuitry, the antenna may become mis-positioned or damaged. Such antenna units typically require a number of manufacturing steps and processes for handling, positioning, and connecting the antennas to the underlying RF transceiver. Additionally, such antennas are often damaged if the radio transceiver unit is vibrated or dropped.

Thus, there is a need in the art for a supporting and holding device for radio frequency (RF) antennas for use in integrating such antennas to an underlying RF transceiver. There is also a need in the art for a device for supporting and holding a pair of strip metal RF antennas prior to and after integration of the antennas with an underlying RF transceiver. There is a further need in the art for a supporting and holding device which may be attached to an underlying printed circuit board in an RF transceiver, independent of attachment of the RF antennas to the underlying printed circuit board. There is a further need in the art for a device for accurately positioning an RF antenna during connection of the RF antenna to underlying circuitry of an RF transceiver. There is a further need in the art for a device for maintaining and supporting an RF antenna after connection of the RF antenna to the circuitry of an RF transceiver such that the RF antenna is protected against damage due to dropping or vibrating the RF transceiver.

SUMMARY OF THE INVENTION

The present invention seeks to provide a supporting and holding device for RF antennas for use in integrating such antennas to an underlying RF transceiver. The present invention provides a device for supporting and holding an RF antenna prior to integration of the antenna with an underlying RF transceiver. After attachment of an RF antenna to the supporting and holding device of the present invention, the supporting and holding device may be attached to an underlying support surface, such as a printed circuit board, independent of attachment of the leads of the RF antenna to the underlying support surface. The antenna supporting and holding device allows for accurate positioning of an RF antenna during connection of the RF antenna to the underlying circuitry of an RF transceiver. The antenna supporting and holding device of the present invention supports the RF antenna and protects the RF antenna against damage due to dropping or vibrating the RF transceiver to which the RF antenna is attached.

More particularly, one aspect of the present invention provides an apparatus for holding, positioning, and supporting antennas attached to a support surface. The apparatus comprises a substrate having an upper surface for receiving a first antenna, a lower surface for receiving a second antenna, and means for attaching the substrate to the support surface independent of the first and second antennas. Preferably, the substrate is molded from a dielectric material. The support surface may include a printed circuit board.

The upper surface of the substrate defines a plurality of retaining stops for retaining the first antenna. The substrate also defines a pair of antenna retaining posts for retaining the second antenna in position relative to the lower surface.

Preferably, the means for attaching the substrate to the support surface includes a pair of posts for insertion into a pair of corresponding holes in the support surface and a clip for springingly engaging the support surface, the clip defining a catch at a lower end of the clip for engaging a lower side of the support surface. The substrate may further define a front side and a back side. Each post of the pair of posts is preferably attached to and extends downward from a flange. The flange extends outward from the front side of the substrate. When the substrate is attached to the support surface, the posts are inserted into the holes in the support surface until the lower surfaces of the flanges are supported on an upper side of the support surface.

The clip extends outward and downward from the front side of the substrate. The substrate may also include a pair of support members extending outward from the front side. Each of the support members defines an indentation on an upper surface of each of the support members for supporting and positioning an electronic component.

In another aspect of the present invention, an improved antenna unit is provided including a molded dielectric substrate for holding, positioning and supporting radio frequency (RF) antennas. A first RF antenna is formed for engagement with and supported by an upper surface of the substrate. The upper surface defines a plurality of retaining stops for retaining the first RF antenna. A second RF Antenna is provided and is formed for engagement with and supported by a lower surface of the substrate. The substrate defines a pair of antenna retaining posts for retaining the second RF antenna in position relative to the lower surface and the substrate has a lower support surface for supporting the second RF antenna. The substrate may define a pair of recesses for receiving a portion of the second RF antenna.

In another aspect of the present invention, a method of holding, supporting and accurately positioning RF antennas for attachment to a printed circuit board is provided. The method comprises the steps of attaching an RF antenna to an upper surface of a molded dielectric substrate and attaching a second RF antenna to a lower surface of the molded dielectric substrate. The method further comprises the steps of retaining the RF antenna in position using a plurality of retaining stops defined along the upper surface and retaining the second RF antenna in position using a pair of antenna retaining posts. The method also comprises the step of attaching the substrate to the printed circuit board prior to attachment of the first and second RF antennas to the printed circuit board.

The step of attaching the substrate to the printed circuit board may comprise the steps of inserting a pair of posts defined on a front side of the substrate into a pair of corresponding holes in the printed circuit board and springingly engaging a clip defined along the front side of the substrate until a catch defined at a lower end of the clip engages a lower side of the printed circuit board. The method may further comprise the step of inserting the pair of posts until the under side of a pair of flanges from which the pair of posts extend rests upon an upper surface of the printed circuit board.

Other objects, features, and advantages of the present invention will become apparent upon review of the following description of the preferred embodiments and the appended drawings and claims.

DETAILED DESCRIPTION OF PREFERRED EMBODIMENT

Figure 1:
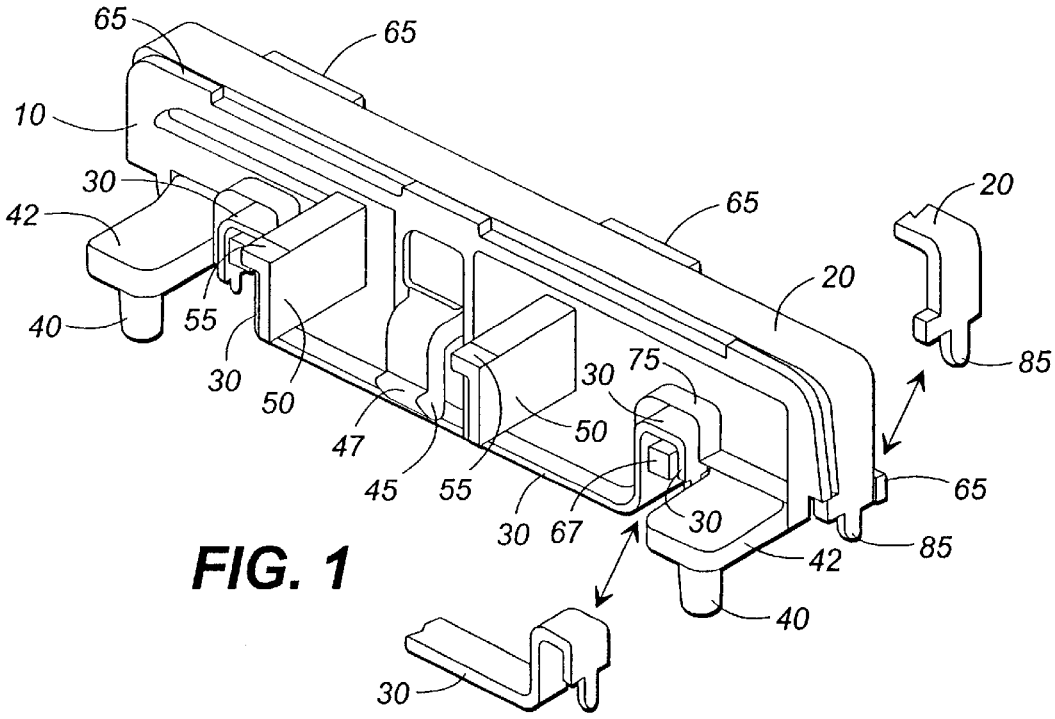
FIG. 1 is a pictorial view of an antenna supporting and holding device embodying the present invention, showing upper and lower RF antennas supported thereon.

Referring now in more detail to the drawings in which like numerals refer to like parts throughout the several views, FIG. 1 shows a radio frequency (RF) antenna supporting and holding device 10 embodying the present invention. The antenna supporting and holding device 10 of the present invention includes a molded dielectric substrate used to hold and support upper and lower RF antennas 20 and 30. With reference to FIGS. 1, 2, 4, and 5, the antenna supporting and holding device 10 may be used to hold, support, and position upper and lower RF antennas 20 and 30 prior to attachment of the RF antennas 20 and 30 to underlying circuitry, such as a printed circuit board (PCB) 100.

After the RF antennas 20 and 30 are combined with the antenna supporting and holding device, as shown in FIG. 1, the antenna supporting and holding device 10 may be connected to the PCB 100 independent of the attachment of the leads 85 and 90 of the RF antennas 20 and 30 to the PCB 100. This feature of the antenna supporting and holding device 10 allows the upper and lower RF antennas 20 and 30 to be accurately positioned on the PCB 100 prior to soldering the leads 85 and 90 of the RF antennas 20 and 30 to corresponding connection points on the PCB 100. Thus, as will be readily understood, the subassembly comprised of the antenna supporting and holding device 10 with attached upper and lower RF antennas 20 and 30 may be assembled separately from attachment of the antennas to the PCB 100. Such separate assembly advantageously may allow the antenna supporting and holding device 10 with attached antennas to be assembled by a separate manufacturer before being shipped to and attached to a PCB 100 in a subsequent manufacturing process.

After soldering the RF antennas 20 and 30 to the PCB 100, the antenna supporting and holding device 10 of the present invention prevents movement or deformation of the RF antennas if the transceiver unit to which they are attached is dropped or vibrated. The subassemblies thus far noted will now be described in detail.

The antenna supporting and holding device 10 of the present invention is preferably constructed from a dielectric material. As is well known to those skilled in the art, a dielectric material is a material which is an electrical insulator or in which an electric field can be sustained with a minimum dissipation of power. The antenna supporting and holding device 10 may be formed from a variety of dielectric materials such as ceramics, plastics, synthetic resins, and glass. In the preferred embodiment, the antenna supporting and holding device 10 is a molded plastic substrate.

Figure 2:
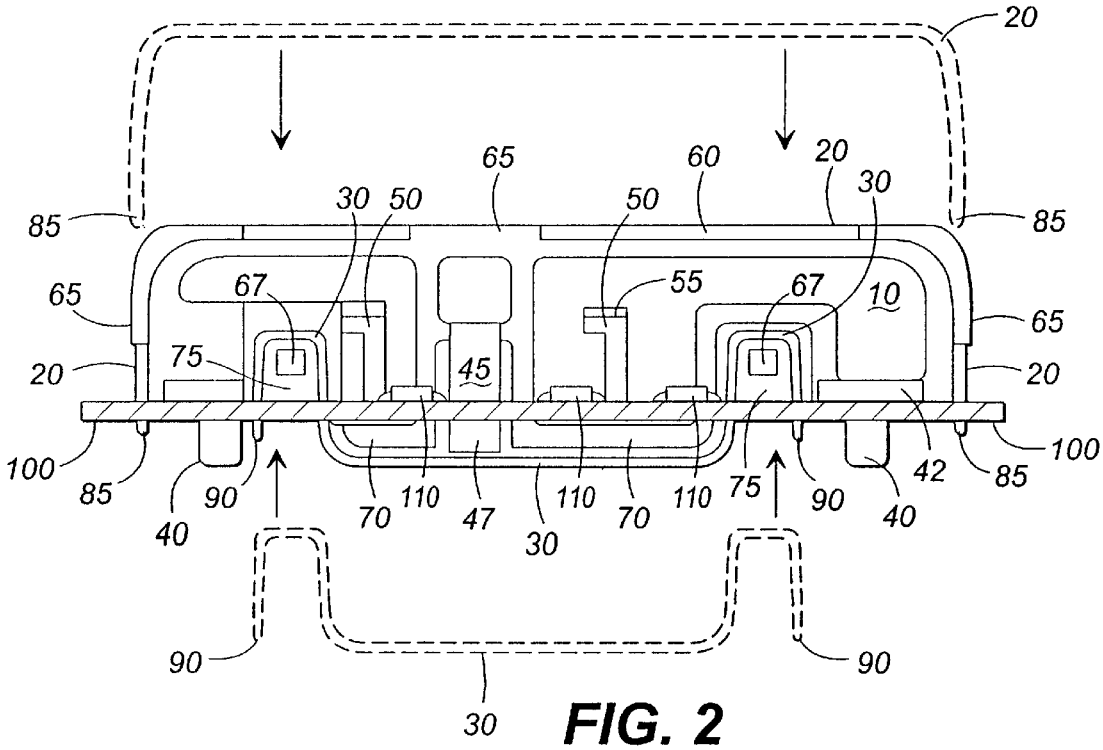
FIG. 2 is a front elevation view of the antenna supporting and holding device of FIG. 1 showing a cross-sectional view of a printed circuit board attached to the antenna supporting and holding device and showing, in phantom, upper and lower RF antennas prior to attachment to the antenna supporting and holding device.
Figure 3:
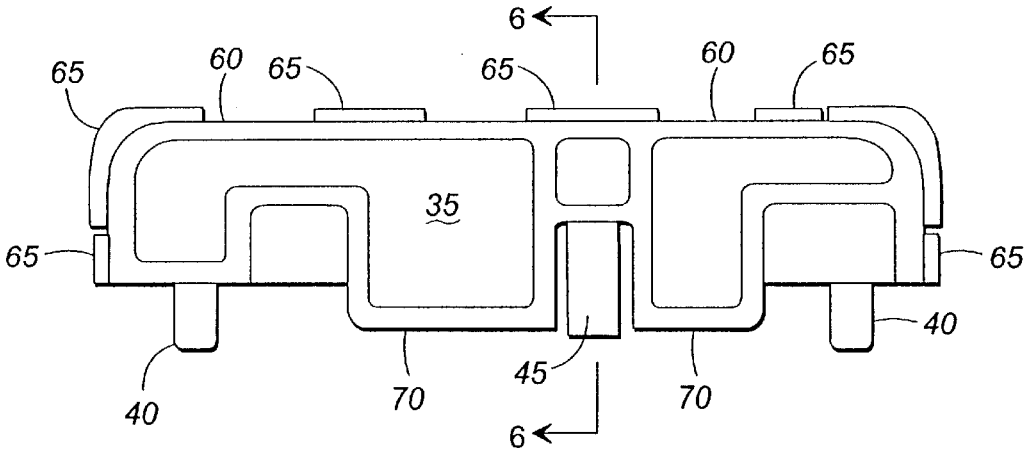
FIG. 3 is a rear elevation view of the antenna supporting and holding device of FIG. 1 without attached RF antennas.
Figure 4:
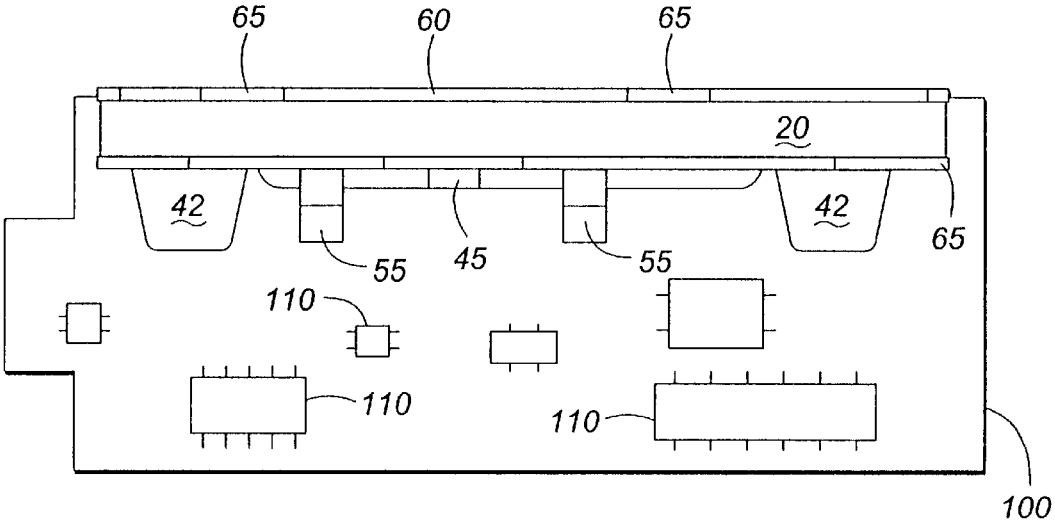
FIG. 4 is top plan view of the antenna supporting and holding device of FIG. 2 showing an attached printed circuit board.
Figure 5:
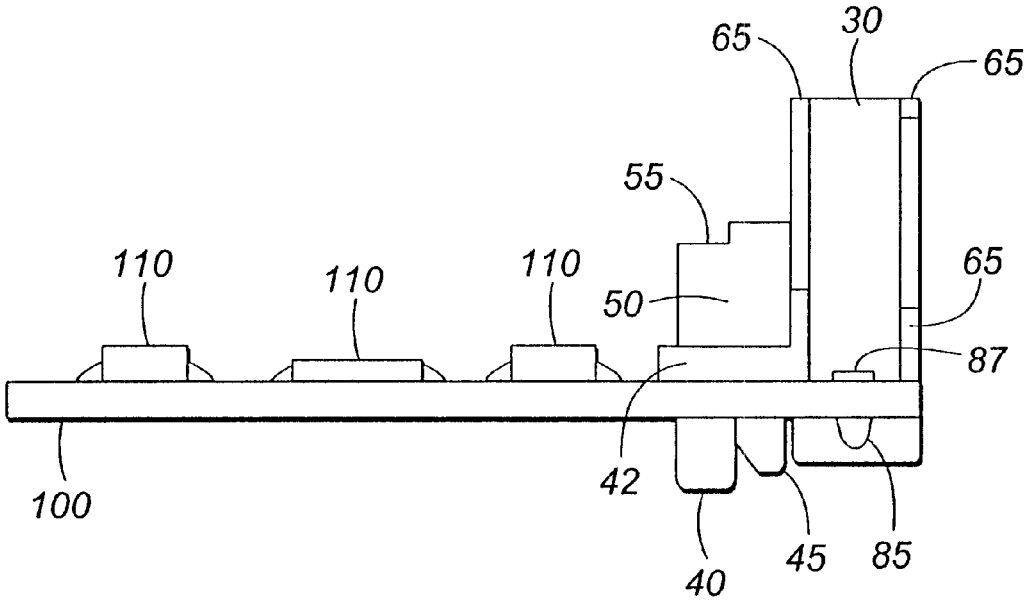
FIG. 5 is a side elevation view of the antenna supporting and holding device of FIG. 4.

As shown in FIGS. 1 and 3, the antenna supporting and holding device 10 includes molded features for receiving the upper and lower RF antennas 20 and 30 and for attachment of the antenna supporting and holding device 10 to an underlying PCB 100. In the preferred embodiment of the present invention, the antenna supporting and holding device 10 is configured for attachment to a PCB 100 for use in a variety of radio frequency transceivers, such as pagers. As is well known to those skilled in the art, the PCB 100 may be a flat board, as shown in FIGS. 2 and 4, with an upper surface which contains slots for electronic components such as resistors, capacitors, integrated circuits, and such as the upper and lower antennas 20 and 30 of the present invention. As shown in FIGS. 4 and 5, a variety of electronic components 110 are illustrated on the upper surface of the PCB 100. The lower surface of a typical printed circuit board is printed with electrically conductive pathways between the components 110 which are attached to the upper surface of the PCB 100.

Referring now to FIGS. 1 and 2, the front side of the antenna supporting and holding device 10 includes a pair of retaining posts 40 for insertion into corresponding holes (not shown) in the PCB 100. The retaining posts 40 extend downwardly from a pair of flanges 42 which outwardly extend from the front side of the antenna supporting and holding device 10. As shown in FIGS. 2 and 5, when the antenna supporting and holding device 10 is attached to a PCB 100, the retaining posts 40 are inserted through corresponding holes in the PCB until the lower surfaces of the flanges 42 rest against the upper surface of the PCB.

Figure 6:
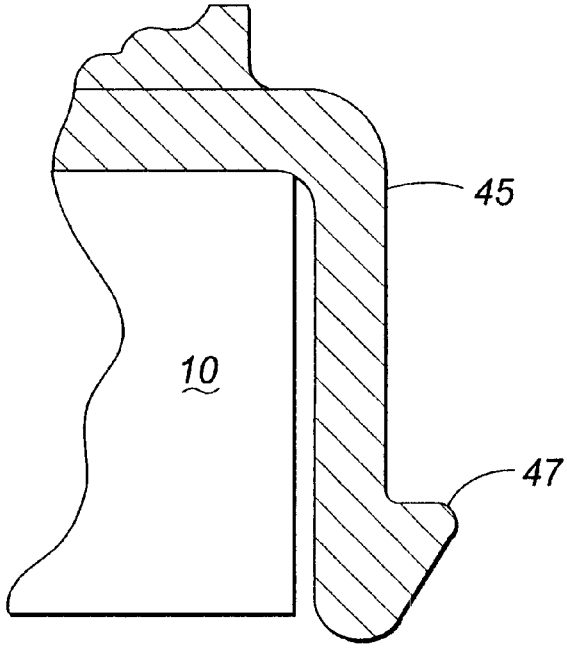
FIG. 6 is a partial side elevation cross-sectional view of the antenna supporting and holding device of FIG. 3 taken along line 6—6.

In the preferred embodiment, the antenna supporting and holding device 10 is attached to the PCB 100 along one side of the PCB 100. As shown in FIGS. 1, 2, and 6, the antenna supporting and holding device 10 includes a retaining clip 45 for retaining the antenna supporting and holding device 10 in a fixed position along the side of the PCB 100. As shown in FIGS. 1, 2, and 6, the retaining clip 45 includes a clip catch 47 for engaging the lower surface of the PCB 100 to urge positively the PCB 100 against the lower surfaces of the flanges 42, as discussed above.

As shown in FIG. 4, the PCB 100 includes an indentation along the side to which the antenna supporting and holding device is attached for receiving the retaining clip 45. In the preferred embodiment of the present invention, as shown in FIG. 2, the lower antenna support surfaces 70 of the antenna supporting and holding device 10 extend beneath the lower surface of the PCB 100 when the antenna supporting and holding device is installed. This configuration allows for support of the lower RF antenna 30, discussed below. Accordingly, as shown in FIGS. 2, 4 and 5, the antenna supporting and holding device 10 is attached to the PCB 100 by inserting the retaining posts 40 into corresponding holes in the PCB 100 until the lower surfaces of the flanges 42 rest upon the upper surface of the PCB 100 and until the clip catch 47 of the retaining clip 45 springingly catches the lower surface of the PCB 100.

The antenna supporting and holding device 10 also includes a pair of inverted L-shaped support members 50. The support members 50 extend from the front surface of the antenna supporting and holding device 10 and provide additional support for attaching the antenna supporting and holding device 10 to the PCB 100. As shown in FIG. 2, the lower surfaces of the support members 50 rest upon the upper surface of the PCB 100 when the antenna supporting and holding device 10 is attached to the PCB 100. As shown in FIG. 5, the upper surfaces of the support members 50 include indentations 55 which may be used to support an overlying circuit board or electronic device (not shown). It should be understood that the molded features of the antenna supporting and holding device 10 may be modified to accommodate different sizes and shapes of RF antennas and different PCB configurations without departing from the scope and spirit of the present invention.

As briefly discussed above, the antenna supporting and holding device 10 of the present invention is used to hold, position and support RF antennas attached to underlying circuitry, such as PCBs 100. As well known to those skilled in the art, the RF antennas supported by the antenna supporting and holding device 10 of the present invention are devices for radiating or receiving radio waves. The RF antennas of the present invention may be made from a variety of materials such as copper or copper alloy.

As shown in FIG. 2, the upper RF antenna 20 preferably is a strip metal antenna molded for configuration with the upper support surface 60 of the antenna supporting and holding device 10. The upper RF antenna 20 is held in position along the upper surface 60 by upper antenna retaining stops 65, shown in FIGS. 1–3. As shown in FIG. 1, the upper RF antenna 20 preferably is integrated with the antenna supporting and holding device 10 prior to attachment of the antenna supporting and holding device 10 to an underlying support surface, such as the PCB 100. In the preferred embodiment, attachment of the antenna supporting and holding device 10 allows the RF antenna 20 to be accurately positioned on the PCB 100 prior to attachment of the RF antenna 20 to the PCB 100 by soldering or other acceptable attachment method.

Referring now to FIGS. 1 and 2, the antenna supporting and holding device 10 is configured to receive and support a lower RF antenna 30 for attachment to the PCB 100. As with the upper RF antenna 20, the lower RF antenna 30 preferably is a strip metal antenna molded for configuration with the lower antenna support members 70 of the antenna supporting and holding device 10. The preferable shape of the lower RF antenna 30 is illustrated in phantom in FIG. 2. As shown in FIG. 2, the lower RF antenna 30 is retained in position along the lower antenna support members 70 by lower antenna retaining posts 67. The lower antenna retaining posts 67 are molded as a part of the antenna supporting and holding device 10. As shown in FIGS. 1 and 2, the lower antenna retaining posts 67 extend outward from the front side of the antenna supporting and holding device 10 and from the interior of the lower antenna recesses 75. The leads 90 of the lower RF antenna 30 extend downward for attachment to the PCB 100.

Accordingly, as with the upper RF antenna 20, discussed above, the lower RF antenna 30 preferably is integrated with the antenna supporting and holding device 10 prior to attachment of the antenna supporting and holding device 10 to an underlying support surface, such as the PCB 100. In the preferred embodiment, attachment of the antenna supporting and holding device 10 allows the lower RF antenna 30 to be accurately positioned on the PCB 100 prior to attachment of the lower RF antenna 30 to the PCB 100 by soldering or other acceptable attachment method.

OPERATION

It is useful to describe the operation of the antenna supporting and holding device 10 as it is used to hold, position and support upper and lower RF antennas 20 and 30 in connection with a PCB 100. It should be understood that the following exemplary operation is described in terms of the preferred embodiment discussed above and that this exemplary operation applies similarly to alternative configurations of the molded antenna supporting and holding device 10.

In use, a strip metal RF antenna 20 is placed upon the upper surface 60 of the antenna supporting and holding device 10, as shown in FIGS. 1 and 2. The RF antenna 20 is formed so that it fits snugly about the support surface 60 of the antenna supporting and holding device 10. The RF antenna 20 is held in position by stops 65. Next, a lower RF antenna 30 is attached to the lower surface of the antenna supporting and holding device 10, as shown in FIGS. 1, and 2, such that the lower RF antenna 30 is held into position by the lower RF antenna retaining posts 67.

The antenna supporting and holding device 10 (with attached upper and lower RF antennas 20 and 30) is then attached to a PCB 100 along one side of the PCB 100, as shown in FIGS. 2 and 4. The retaining posts 40 are inserted into a pair of corresponding holes in the PCB 100 until the lower surfaces of the flanges 42 come into contact with the upper surface of the PCB 100 and until the lower surfaces of the support members 50 rest against the upper surface of the PCB 100, as shown in FIGS. 2 and 5. Simultaneous to inserting the retaining posts 40, the retaining clip 45 is springingly urged past the side surface of the PCB 100 until the clip catch 47 of the retaining clip 45 passes beneath the lower surface of the PCB 100 to catch the lower surface of the PCB 100 and to positively urge the PCB 100 against the lower surfaces of the flanges 42, as shown in FIGS. 2 and 5.

As the antenna supporting and holding device 10 is attached to the PCB 100, as described, the upper and lower RF antennas 20 and 30 are accurately positioned about the PCB 100. The leads 85 and 90 of the upper and lower RF antennas 20 and 30 are inserted through corresponding antenna lead slots (not shown) in the PCB 100, as shown in FIG. 2. The upper and lower antennas 20 and 30 are then fixed to the PCB 100 by soldering the leads 85 and leads 90 to the PCB 100.

The antenna supporting and holding device 10 attached to the PCB 100, as described, provides for strong support for the upper and lower RF antennas 20 and 30. Additionally, the antenna supporting and holding device 10 prevents movement or deformation of the antennas if the transceiver unit to which the antennas are attached is dropped or vibrated.

While the present invention in its various aspects has been described in detail with regard to preferred embodiments thereof, it should be understood that variations, modifications and enhancements may be made to the disclosed apparatus and procedures without departing from the spirit and scope of the present invention as defined in the appended claims.

What is claimed is:

1. An apparatus for holding, positioning, and supporting antennas attached to a support surface, comprising:

a substrate having an upper surface for receiving a first antenna, a lower surface for receiving a second antenna, and means for attaching said substrate to said support surface independent of said first and second antennas, said means for attaching said substrate to said support surface comprising:

a pair of posts for insertion into a pair of corresponding holes in said support surface; and a clip for springingly engaging said support surface, said clip defining a catch at a lower end of said clip for engaging a lower side of said support surface.

2. The apparatus of claim 1, wherein said upper surface of said substrate defines a plurality of retaining stops for retaining said first antenna.

3. The apparatus of claim 2, wherein said substrate further defines a pair of antenna retaining posts for retaining said second antenna in position relative to said lower surface.

4. The apparatus of claim 1, wherein said substrate further defines a front side and a back side; and wherein each post of said pair of posts is attached to and extends downward from a flange, said flange extending outward from said front side of said substrate;

whereby when said substrate is attached to said support surface, said posts are inserted into said holes in said support surface until the lower surfaces of said flanges are supported on an upper side of said support surface.

5. The apparatus of claim 4, wherein said substrate further comprises:

a pair of support members extending outward from said front side;

wherein each of said support members defines an indentation on an upper surface of each of said support members for supporting and positioning an electronic component.

6. The apparatus of claim 1, wherein said clip extends outward and downward from said front side of said substrate.

7. The apparatus of claim 1, wherein said substrate is molded from a dielectric material.

8. The apparatus of claim 1, wherein said support surface is a printed circuit board.

9. An improved antenna unit, comprising:

a molded dielectric substrate for holding, positioning and supporting radio frequency (RF) antennas;

a first RF antenna formed for engagement with and supported by an upper surface of said substrate, said upper surface defining a plurality of retaining stops for retaining said first RF antenna;

a second RF antenna formed for engagement with and supported by a lower surface of said substrate, said substrate defining a pair of antenna retaining posts for retaining said second RF antenna in position relative to said lower surface; and said substrate having means for attaching said substrate to a printed circuit board independent of said first and second RF antennas.

10. The antenna unit of claim 9, wherein said substrate further defines a front side and a back side, and wherein said means for attaching said substrate to said printed circuit board comprises:

a pair of posts for insertion into a pair of corresponding holes in said printed circuit board, said pair of posts being attached to and extending downward from a pair of flanges, said flanges extending outward from said front side of said substrate; and a clip for springingly engaging said printed circuit board, said clip defining a catch at a lower end of said clip for engaging a lower side of said printed circuit board;

whereby when said substrate is attached to said printed circuit board, said posts are inserted into said holes in said printed circuit board until the lower surfaces of said flanges are supported on an upper side of said printed circuit board.

11. The antenna unit of claim 10, wherein said substrate further comprises:

a pair of support members extending outward from said front side;

wherein each of said support members defines an indentation on an upper surface of said support members for supporting and positioning an electronic component.

12. The antenna unit of claim 11, wherein said substrate further comprises a pair of recesses in said lower surface for receiving a portion of said second RF antenna.

13. The antenna unit of claim 9, wherein said first and second RF antennas are strip metal antennas.

14. An apparatus for holding, positioning, and supporting radio frequency (RF) antennas attached to a printed circuit board, comprising:

a molded dielectric substrate, including;

an upper surface for receiving a first RF antenna, said upper surface defining a plurality of retaining stops for retaining said first RF antenna;

a pair of antenna retaining posts for retaining a second RF antenna in position relative to a lower surface of said substrate;

a pair of recesses in said lower surface for receiving a portion of said second RF antenna;

a pair of support members extending outward from a front side of said substrate, said support members defining an indentation on an upper surface of each of said support members for supporting and positioning an electronic component; and means for attaching said substrate to a printed circuit board independent of attachment of said first and second RF antennas to said printed circuit board.

15. The antenna unit of claim 14, wherein said means for attaching said substrate to said printed circuit board comprises:

a pair of posts for insertion into a pair of corresponding holes in said printed circuit board, said pair of posts being attached to and extending downward from a pair of flanges, said flanges extending outward from said front side of said substrate; and a clip for springingly engaging said printed circuit board, said clip defining a catch at a lower end of said clip for engaging a lower side of said printed circuit board;

whereby when said substrate is attached to said printed circuit board, said posts are inserted into said holes in said printed circuit board until the lower surfaces of said flanges are supported on an upper side of said printed circuit board.

16. A method of holding, supporting and accurately positioning RF antennas for attachment to a printed circuit board, comprising the steps of:

attaching a first RF antenna to an upper surface of a molded dielectric substrate;

attaching a second RF antenna to a lower surface of said molded dielectric substrate;

retaining said first RF antenna in position using a plurality of retaining stops defined along said upper surface;

retaining said second RF antenna in position using a pair of antenna retaining posts; and attaching said substrate to said printed circuit board prior to attachment of said first and second RF antennas to said printed circuit board.

17. The method of claim 16, wherein said step of attaching said substrate to said printed circuit board comprises the steps of:

inserting a pair of posts defined on a front side of said substrate into a pair of corresponding holes in said printed circuit board; and springingly engaging a clip defined along said front side of said substrate until a catch defined at a lower end of said clip engages a lower side of said printed circuit board.

18. The method of claim 17, further comprising the step of:

inserting said pair of posts until the under side of a pair of flanges from which said pair of posts extend rests upon an upper surface of said printed circuit board.

* * * * *